United States Patent [19]

Di Martini et al.

[11] 4,404,026

[45] Sep. 13, 1983

[54] PROCESS FOR SEPARATION OF DROSS ELEMENTS COMBINING SODIUM ADDITION TO MOLTEN BULLION FOLLOWED BY CONTROLLED SOLIDIFICATION OF CASTING

[75] Inventors: Carl R. Di Martini, Piscataway; John E. Casteras, Colonia, both of N.J.

[73] Assignee: ASARCO Incorporated, New York, N.Y.

[21] Appl. No.: 400,777

[22] Filed: Jul. 22, 1982

[51] Int. Cl.[3] ..... C22B 13/06

[52] U.S. Cl. ..... 75/63; 75/78

[58] Field of Search ..... 75/78, 77, 63

[56] References Cited

U.S. PATENT DOCUMENTS 4,333,763 6/1982 Di Martini et al. ..... 75/77

*Primary Examiner*—M. J. Andrews

*Attorney, Agent, or Firm*—John J. Tomaszewski; Kenneth A. Koch

[57] ABSTRACT

A method for the introduction of sodium into lead bullion followed by controlled solidification results in higher recovery of lead from the matte and speiss, and the elimination of the expensive undesirable dross reverberatory practice.

10 Claims, 3 Drawing Figures

FIG. 1
PRIOR ART
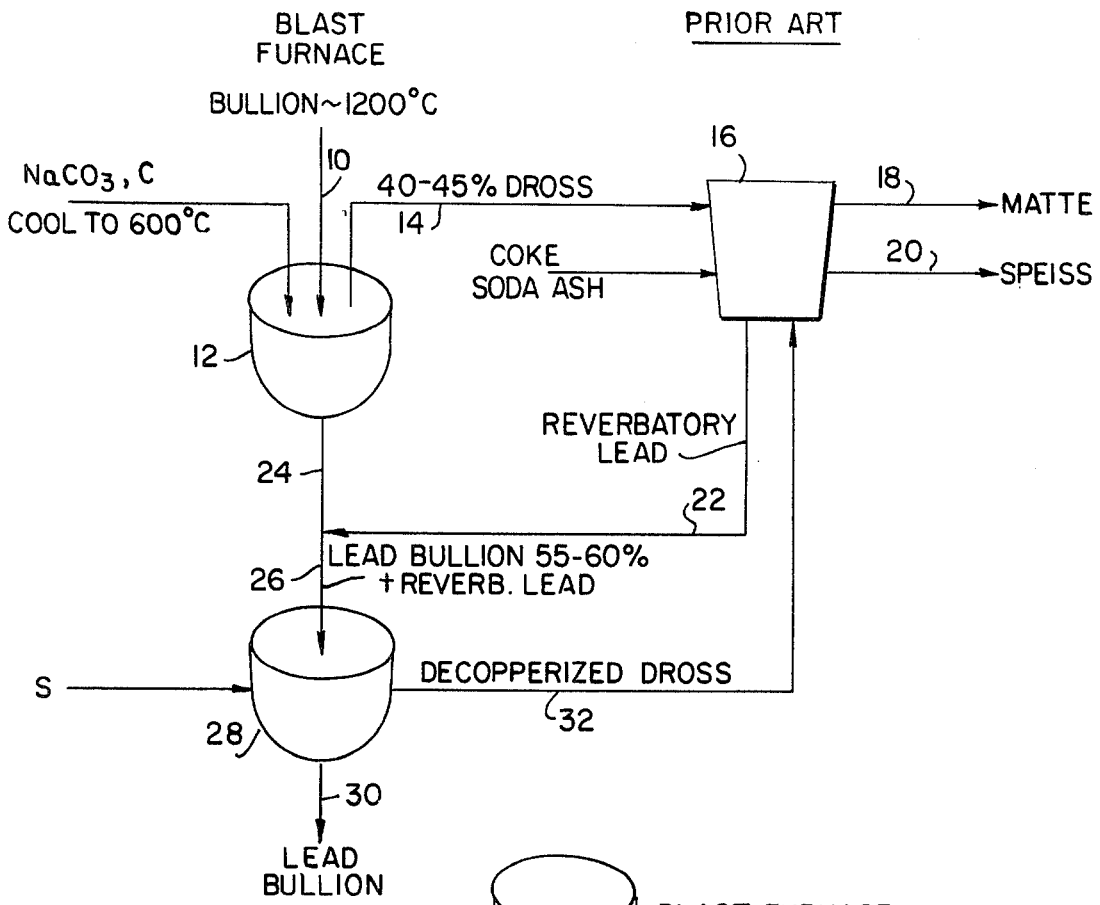
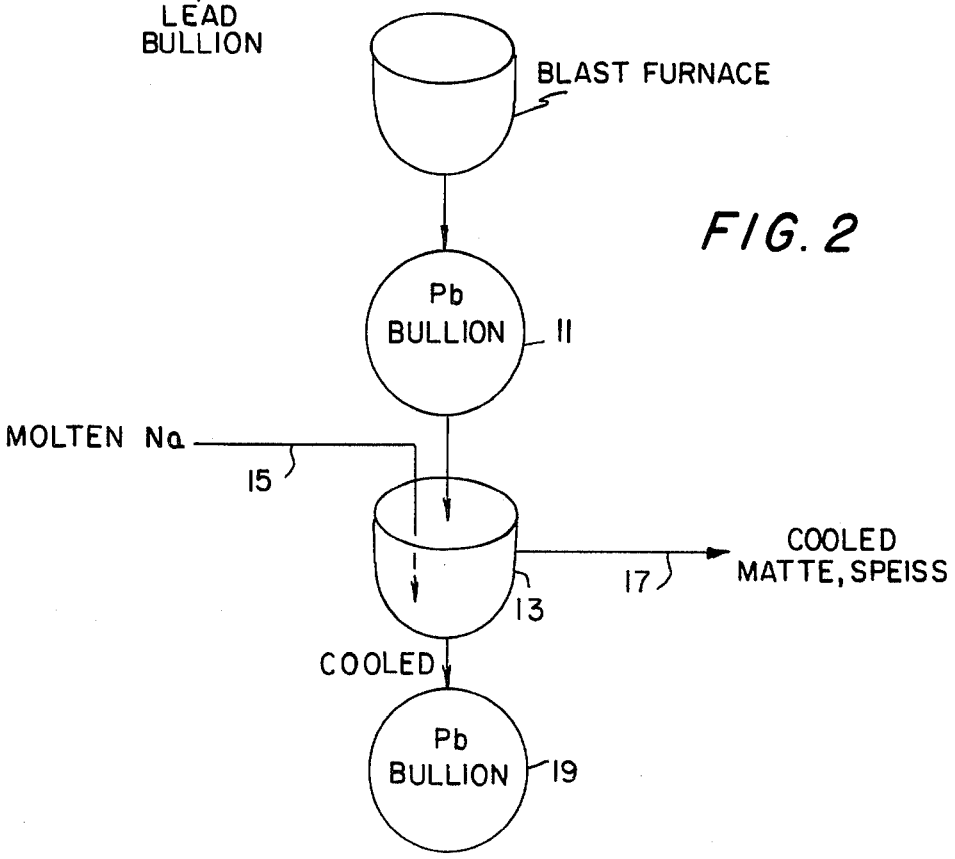
FIG. 2

EFFECT OF AVERAGE SOLIDIFICATION COOLING RATE ON THE CASTING FRACTION SEPARATING AS Pb-RICH "SHIPPING BULLION"
TYPICAL CONVENTIONAL DROSSING RANGE
TYPICAL CASTING CONDITIONS
FURNACE COOL
WATER COOLED MOLD
GRANULATION
CASTING FRACTION SEPARATING AS Pb-RICH "SHIPPING BULLION" (%)
70
60
50
40
30
20
10
0
0.1
1
10
100
1000
10000
AVERAGE SOLIDIFICATION COOLING RATE (°C/MIN.)

PROCESS FOR SEPARATION OF DROSS ELEMENTS COMBINING SODIUM ADDITION TO MOLTEN BULLION FOLLOWED BY CONTROLLED SOLIDIFICATION OF CASTING

BACKGROUND OF THE INVENTION

This invention relates to the treatment of lead bullion containing copper and other impurities and more particularly to a novel process for separating the metallic lead contained within the dross constituents without the use of the dross reverberatory furnace. Such a process results in the elimination of an expensive, environmentally objectionable operation, without any decrease in performance produced by the conventional "rough drossing" separating and treating operation.

DESCRIPTION OF THE PRIOR ART

U.S. Pat. No. 2,110,445 discloses a process for purifying lead bullion containing the usual small amounts of arsenic, copper, tin, antimony, bismuth and noble metals involving adding a small amount of metallic sodium to a molten bath of the lead bullion. The dross is thereafter skimmed from the bath, thereby obtaining a lead containing less than 0.1% arsenic and less than 0.005% copper. U.S. Pat. No. 2,691,575 discloses a process for converting lead oxide to lead and particularly to the treatment of lead oxide slags obtained in the refining of impure by-product lead produced in the manufacture of a tetraethyl lead. The process comprises heating a fluid mixture of lead oxide and sodium hydroxide at temperatures of from 327° C. to about 450° C., mixing with such mixture about 10% to about 30% by weight of metallic sodium based on the lead oxide, and separating molten lead from the reaction mixture.

U.S. Pat. No. 3,607,232 discloses a process for detellurizing lead which includes adding a metallic alkali metal to a molten lead pool to form a tellurium containing layer of slag, and removing the slag from the lead pool. U.S. Pat. No. 4,033,761 discloses a process for the separation of copper sulfide from metallic lead mechanically entrained in a rough copper dross obtained from the copper drossing of lead bullion, involving heating the dross and an alkali metal sufide together in a kettle at an elevated temperature not in excess of 1200° F. to melt together the dross and alkali metal sulfide. The thus-obtained molten dross releases the entrained molten lead which passes to the kettle bottom, and the copper sulfide of the molten dross and the alkali metal sulfide form a low melting copper sulfide-alkali metal sufide matte layer on the surface of a pool of the released molten lead. U.S. patent applications Ser. Nos. 132,239 and 132,240 disclose the separation of lead from lead sulfide ores by a process including the addition of an alkali metal such as sodium to a molten lead pool in an amount sufficient to reduce the combined lead of the lead sulfide to metallic lead, adding the ore concentrate to the molten lead pool, and mixing together the metallic sodium, molten lead and ore concentrate. The sodium reacts rapidly and exothermically with the lead sulfide to reduce the combined lead of the lead sulfide to metallic lead and form sodium sulfide. The thus-liberated metallic lead reports in the molten lead pool, and a matte phase containing the sodium sulfide separates from the molten lead and forms on the surface of the molten lead pool.

As can be seen from these prior art processes, several similar techniques have evolved for treating and separating metallic lead from lead bullion and the matte, speiss and slag phases which coexist therein. These metallurgical by-products, known in the art as "rough dross," are usually processed after exiting the blast furnace by being charged into a reverberatory furnace, together with such reagents as soda ash and coke, then melted, whereupon a second matte and, speiss product, each containing about 10–15% Pb is produced, while in the process liberating some of the entrained lead within the dross, which flows down into the molten lead pool. However, this step of treating the dross is expensive, energy intensive, environmentally obnoxious, and one that the art is desirous of eliminating from the lead processing cycle.

Accordingly, it is an object of the invention to substantially separate the matte and speiss phases from the lead bullion without the need for the dross reverberatory furnace step.

It is another object of the invention to substantially reduce environmental pollution during the processing of lead bullion.

It is still another object of the invention to discover a process that requires substantially less energy to separate lead from lead containing substances than those currently known.

SUMMARY OF THE INVENTION

These and other objects of the invention have been accomplished by a method of an addition of chemical reagents followed by a controlled solidification of the blast furnace bullion, thereby eliminating the need for the dross reverberatory furnace separation, comprising first forming a pool of molten lead bullion, preferably heated to a temperature of about 1100°–1200° C., casting the bullion into an effective container means, preferably a massive cast iron mold which is resistant to molten lead, cooling the cast bullion to a predetermined temperature, i.e., about 700°–800° C. while forming a partial matte crust over the surface of the bullion; adding a sodium-containing reagent selected from the group consisting of metallic sodium, and $Na_2CO_3$, either alone or with coke; the preferred sodium containing reagent being liquid metallic sodium in amounts of about 0.5–4.0 wt. %, and most preferably, 0.5–2.0%, of the bullion. The metallic sodium reagent, preferably heated to about 120° C., is added to the lead bullion beneath the surface of the lead pool, so as to avoid an oxidation reaction with air. The sodium then reacts with the lead bearing substances, present primarily as PbS of the matte, together with a smaller amount of PbS found in the speiss, to form elemental lead, while a matte primarily comprising a $Na_2S$—$Cu_2S$ mixture and a speiss primarily comprising a $Cu_3As$, $Cu_3Sb$ and $Fe_2As$ mixture forms on the surface of the molten lead pool; the elemental lead formed falling into the molten lead pool. Upon further gradual cooling to a predetermined temperature, preferably about 350°–400° C., the matte and speiss each have a low lead content which is no more than the level of that found in the speiss and matte produced by the dross reverberatory furnace, and can be substantially less.

BRIEF DESCRIPTION OF THE DRAWINGS

FIG. 1 is a schematic outline of the prior art method of performing the present invention.

FIG. 2 is a schematic outline of an embodiment of the present invention.

DETAILED DESCRIPTION OF THE INVENTION

Figure 3:
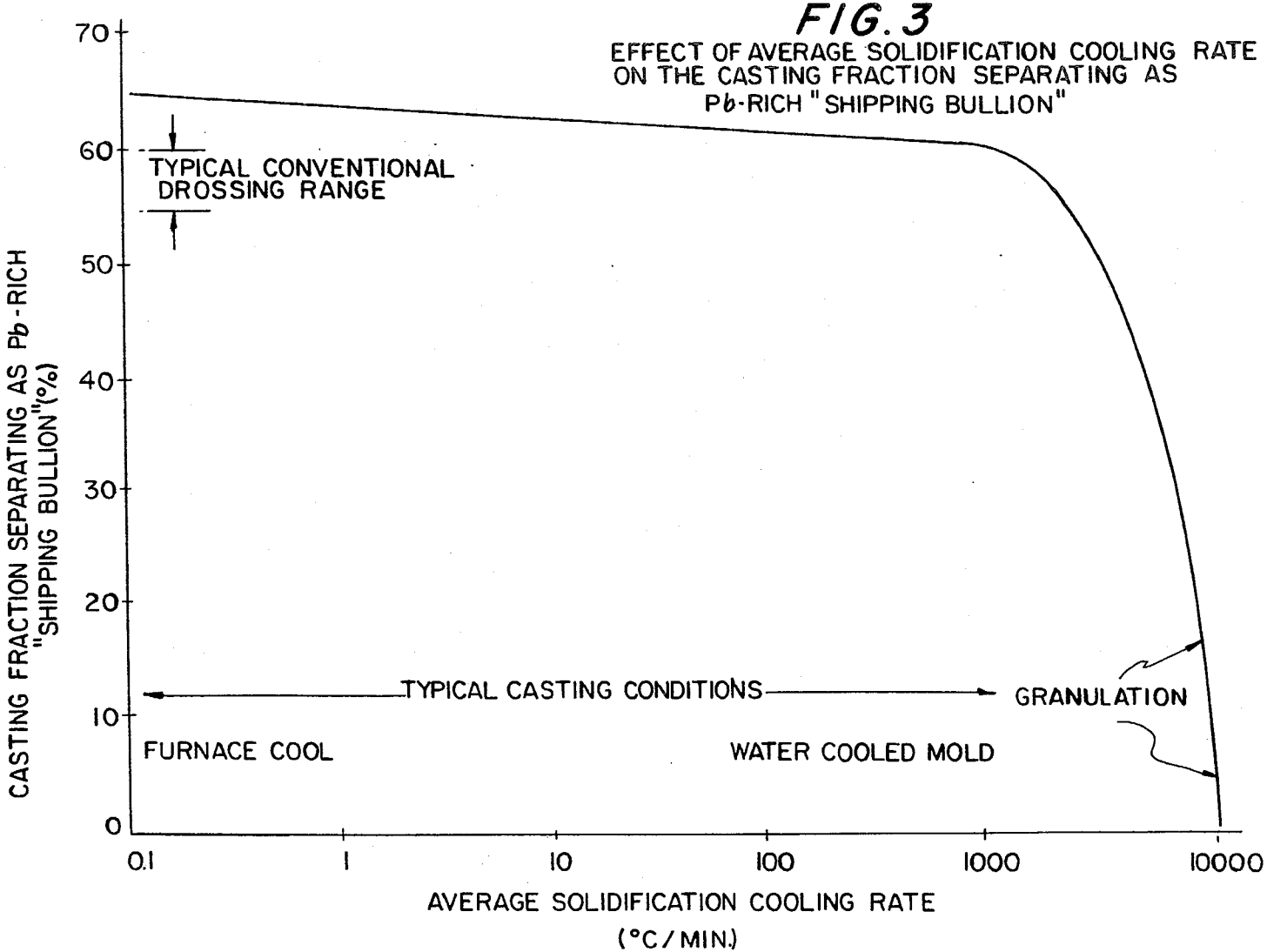
FIG. 3 discloses the effect the rate of cooling has on the amount of lead entrained in the bullion.

In the separation of lead from the various impurities present in blast furnace bullion that has been heated to temperatures of the order of 1100°-1200° C., the bullion is first cooled as it separates into three phases; the matte, speiss, and lead bullion. The matte present is composed primarily of a PbS-$Cu_2S$ mixture, while the speiss phase usually consists of $Cu_3As$, $Cu_3Sb$, and $Fe_2As$, intermingled with an additional emulsion of very fine PbS-$Cu_2S$ matte particles. The density differences among the three phases is the driving force in the separation; matte, being the least dense, floats to the top, the speiss assumes the intermediate level, while the elemental lead sinks to the bottom.

Stokes law provides that the rate of ascent R of a hypothetical spherical solid particle of radius r, in a denser liquid having a viscosity $\eta$, is the following;

$$R = 2/9\, gr^2 \frac{\Delta D}{\eta}$$

where $\Delta$ D is the difference in density between the liquid and solid. This relationship enables one to determine the parameters necessary for the matte particles to be able to successfully pass through the speiss phase. In a solidification process, the distance and time in which a solid particle may separate from a more dense liquid are limited by composition and the rate of cooling; there is a critical diameter for each particle, below which its separation from the solidifying phase will not be favored. In the example of matte particles ascending through a liquid speiss at 1000° C., the critical diameter is approximately 16 microns, i.e., matte particles with an average diameter smaller than this cannot be expected to migrate through the developing speiss layer and may very well become trapped within. Furthermore, the motion of the liquid metal can also maintain in suspension solid particles larger than the critical size. Thus, due to the mechanics of separation, a fraction of the $Cu_2S$-PbS matte constituent present in globules less than about 10-20 microns in diameter can become trapped in the solidifying speiss layer, requiring further treatment of the speiss to effect satisfactory lead recovery.

The prior art has relied on a soda matte process undertaken in a dross reverberatory furnace to recover this entrained lead in the speiss together with the PbS contained in the matte, applicants believe, by providing time for a reaction between the lead sulfide particles in the matte and speiss layers and the soda matte reagents, soda ash and coke. This process also permits a separation of these different layers, aided by the reduced density of the sodium bearing matte, the relatively high temperatures involved, and the consequent low viscosity, all such properties being predicted by Stokes Law. FIG. 1 illustrates this process, whereby blast furnace lead bullion 10 is first charged into kettle 12 at a temperature of about 1100°-1200° C., whereupon $Na_2CO_3$ and coke are then added. The metal is cooled to about 600° C., additional sodium carbonate and coke are added and the metal is stirred. After a period of time the surface dross layer 14, which typically comprises about 40-45% of the charged material, is removed from the kettle, cooled to a solid state, and then charged into dross reverberatory furnace 16. Soda ash and coke are added to furnace 16, the dross is heated to about 800° C., whereupon the dross separates into matte 18 and speiss 20, each containing significantly lower, i.e. about 10-15%, lead than existed in the dross before processing in the reverberatory furnace 16. However, this so called "rough drossing" operation is expensive involves considerable physical and mechanical handling of large quantities of hot bullion and dross, together with a concurrent evolution of fumes containing harmful reagent dusts and oxides of Pb, Sb and As, and thus the art has searched for an improved technique for some time.

Upon the conclusion of the rough drossing operation, lead pool 22 formed within the reverberatory furnace is combined with the lead bullion product 24 exiting furnace 12, usually comprising about 55-60% of the original lead charge 10, to form lead bullion charge 26, which is then fed into finishing kettle 28, sulfur is added to decopperize the lead, and the lead is again cooled and separated into lead bullion product 30, and decopperizing dross 32, which is usually recycled back to dross reverberatory furnace 16, and the process repeated.

Applicants have discovered an improved process for the separation of most of the entrained lead from the blast furnace dross, which eliminates the need for this "rough drossing" operation, and which takes advantage of the surprisingly strong tendency for a natural separation of the respective dross components. As seen in FIG. 2, applicants' process involves the forming of a pool of lead bullion 11, casting the bullion into a means for containing it, preferably a massive cast iron heat resistant mold, partially cooling the bullion to a predetermined termperature at which temperature a matte crust covers the molten bullion, injecting a sodium containing reagent beneath the surface of the bullion, the sodium reagent primarily reacting with the PbS component of the matte and speiss, the entrained lead falling to the bottom forming a substantially pure lead phase, the matte and speiss constituents 17 solidifying during cooling and subsequently agglomerate and can be separated from the lead rich phase 19; the final composition of the matte and speiss constituents being approximately equivalent in lead content to that produced in the "rough drossing" operation in the dross reverberatory furnace.

The sodium containing reagent added to the bullion beneath the surface of the matte crust is preferably molten metallic sodium, although $Na_2CO_3$ and $Na_2CO_3$/coke have also been shown to decrease matte and speiss lead levels. However, $Na_2SO_4$ and $Na_2S$ flake additions have proved to be ineffective for recovering lead.

In a more preferred embodiment of the invention, molten lead bullion having the composition set forth in Table I, but which is not limited thereto, is tapped from the blast furnace into a massive cast iron heat resistant mold and cooled to about 750° C., at which time the lead bullion is injected with molten sodium metal in amounts of about 0.5-4.0%, most preferably, 0.5-2.0% of the bullion, applied through a lance beneath the matte surface, and allowed to react with the PbS component of the molten metal, whereupon the metal is cooled for a predetermined time period, preferably 5 to 6 hours, at the completion of which the matte-speiss "skull," which now contains about 10% lead, is then separated from the lead bullion for further processing. The remainder of the charge, the lead bullion, comprising about 75% or more of the original charge, is ready for further processing, such as final decopperization.

As is seen in FIG. 3, the rate of cooling of the bullion can influence the amount of the lead entrained, particularly if the cooling rate exceeds 1000° C./min; however, at rates envisioned under the method, the percentage of charge which separates out as elemental lead is substantially constant.

EXAMPLE I

In Table 2, the results of a laboratory injection of molten sodium metal into molten bullion is shown. Earlier work has shown that the addition of sodium into molten blast furnace bullion at 1100° C. caused excessive overheating of the charge coupled with consequent sodium loss. Accordingly, 0.28 lbs. of molten sodium metal, an amount equal to 1.7 wt.% of the bullion, was injected at 775° C. into 16.79 lbs of a sample of lead bullion taken from ASARCO Incorporated's East Helena Smelter. The sodium was introduced beneath a matte crust covering the melt so as to prevent any loss of sodium from the bullion. After completion of the reaction, the sample was cooled and analyzed. As illustrated in Table 2, lead levels and Cu/Pb ratios comparable to those found in matte and speiss (10% and 5:1 respectively) produced by the conventional rough drossing technique are produced.

EXAMPLE II

In Table 3 are seen the results of several laboratory scale reagent additions to three different matte and speiss castings; sample #1 was solidified directly from the blast furnace bullion, while castings #2 and #3 were treated during casting by the addition of soda ash ($Na_2CO_3$) to the mold. The results indicate that even under extremely slow cooling of laboratory remelted matte and speiss, less than 5% of the entrained lead was separated, and even less lead separated from the castings which had soda ash present during solidification. These results suggest that only a small fraction of the lead present is mechanically entrained, and that the presence of soda ash during solidification is associated with a chemical reduction of lead compounds from the matte and speiss.

The introduction of $Na_2CO_3$, $Na_2CO_3$/coke, and especially Na metal reagents to molten matte and speiss samples led to the recovery of substantial amounts of lead, as can be clearly seen from Table 3. However, neither $Na_2SO_4$ nor $Na_2S2\ \frac{1}{2}\ H_2O$ recovered any lead from the samples treated by this technique.

EXAMPLE III

Table IV illustrates the results of a plant test in which 80 lbs. of molten sodium at 110° C. (1.1%) were injected beneath the surface of 7580 lbs. of East Helena blast furnace bullion which had cooled to a temperature of about 750° C. The sodium was injected beneath the surface of the melt through a heated steel pipe, although no particular apparatus is critical to the performance of the separation. Upon finishing adding the sodium, the temperature of the bullion increased to about 850° C. due to the heat of reaction generated from the sodium reaction with the bullion. A pin was then inserted and the mixture cooled, resulting in the separationand solidification of matte, speiss and lead phases. At 200° C. the casting was removed and the solid phases separated. Over 84% of the original charge was removed as the lead phase, or, "shipping bullion." A small amount of matte constituting less than 2% of the charge and containing about 0.8% lead and a speiss phase constituting 14% of the charge and containing 7.62% lead were also removed for further processing.

TABLE 1

| Typical Composition of Blast Furnace Bullion | |
|---|---|
| Pb | 74.9% |
| Cu | 12.4% |
| As | 4.1% |
| Sb | 2.6% |
| S | 1.5% |
| Fe | 1.1% |
| Zn | 0.64% |
| Ag | 0.66% |

TABLE 2

Liquid Na Laboratory Injection Test Into Blast Furnace Bullion at 775° C.
Materials Balance

| | Pb | Cu | As | Sb | Na* | S | Ag |
|---|---|---|---|---|---|---|---|
| 16.79 lb. Bullion | 77.4% | 11.4% | 1.5% | 3.84% | — | 1.6% | 0.79% |
| | 13.00 lb | 1.91 lb | 0.25 lb | 0.64 lb | — | 0.27 lb | 0.13 lb |
| 0.28 lb Na (1.7% bullion charged) | — | — | — | — | 100% | — | — |
| | — | — | — | — | 0.28 lb | — | — |
| 17.07 lb | 13.00 lb | 1.91 lb | 0.25 lb | 0.64 lb | 0.28 lb | 0.27 lb | 0.13 lb |
| 13.78 lb "Shipping" Bullion | 90.8% | 1.9% | 0.24% | 2.97% | 0.03% | 0.0006% | 0.79% |
| | 12.51 lb | 0.26 lb | 0.03 lb | 0.41 lb | 0.00 lb | 0.00 lb | 0.11 lb |
| 1.48 lb Matte (8.7% casting) | 11.3% | 52.3% | 0.35% | 0.11% | 15.1% | 21.5% | 0.34% |
| | 0.17 lb | 0.77 lb | 0.01 lb | 0.00 lb | 0.22 lb | 0.32 lb | 0.00 lb |
| 1.81 lb Speiss (10.6% casting weight) | 11.5% | 54.2% | 7.4% | 9.4% | 0.002% | 0.47% | 1.08% |
| | 0.21 lb | 0.98 lb | 0.24 lb | 0.17 lb | 0.00 lb | 0.01 lb | 0.02 lb |
| 17.07 lb casting weight | 12.89 lb | 2.01 lb | 0.17 lb | 0.58 lb | 0.22 lb | 0.33 lb | 0.13 lb |

$\frac{Cu}{Pb}$ matte $= 4.6\ \frac{Cu}{Pb}$ speiss $= 4.7\ \frac{Speiss}{Matte} = \frac{1.81}{1.48} = 1.2$

*Some unmeasured amount of Na remained in the pump and inlet pipe and burned off after the test.

TABLE 3

Summary of Laboratory Treatments of Test Casting Constituents

| Treatment | Sample** | Metallic Pb Recovered (As a Percent of Constituent Charged) From Matte | Speiss |
|---|---|---|---|
| Remelting and very | 1 | 2.3% | 4.2% |
| Slow Cooling to | 2 | 0.0% | 3.4% |
| Solid | 3 | 0.0% | 0.0% |
| $Na_2CO_3$* | 1 | 7.0% | 7.8% |
| | 2 | 3.9% | 4.1% |
| | 3 | 3.5% | 3.7% |
| $Na_2CO_3$* + Coke | 1 | 10.1% | 9.3% |
| | 2 | 4.6% | 3.5% |
| | 3 | 3.8% | 2.9% |
| Na* Metal | 1 | 61.6% | 50.1% |
| | 2 | 33.3% | 25.3% |
| | 3 | 41.1% | 35.1% |
| $Na_2SO_4$* | 1 | 0.0% | 0.0% |

TABLE 3-continued

Summary of Laboratory Treatments of Test Casting Constituents

| Treatment | Sample** | Metallic Pb Recovered (As a Percent of Constituent Charged) From Matte | Speiss |
|---|---|---|---|
| | 2 | 0.0% | 0.0% |
| | 3 | 0.0% | 0.0% |
| $Na_2$*S 2-.2 | 1 | 0.0% | 0.0% |
| | 2 | 0.0% | 0.0% |
| | 3 | 0.0% | 0.0% |

*Amount of reagent added was based on an equivalent amount of Na metal (50g) and proportioned to the charge weight.

**1 - Unmodified Blast Furnace Bullion Casting 2 and 3 - Soda Ash Modified Castings.

TABLE 4

Liquid Sodium Plant Injection Test Into Blast Furnace Bullion

| Phase | Weight (lbs) | Wt % Pb | Cu | As | Sb |
|---|---|---|---|---|---|
| Matte | 131 | .77 | 17.1 | 1.4 | 0.01 |
| Speiss | 1149 | 7.62 | 57.1 | 13.4 | 10.1 |
| Lead "Shipping Bullion" | 6380 | 94.5 | 0.12 | 0.21 | 4.3 |

wt. % Pb recorded in "Shipping Bullion" $= \frac{6380}{7580} = 84.1$

We claim:

1. A process for the separation of elemental lead from blast furnace bullion containing a substantial amount of PbS comprising:

forming a pool of molten lead bullion;

casting the bullion into a heat resistant mold;

cooling the cast bullion to a predetermined temperature to form a partial matte crust covering the surface of the bullion;

adding a sodium-containing reagent selected from the group consisting of metallic sodium, $Na_2CO_3$ and $Na_2CO_3$/coke to the lead bullion, the sodium-containing reagent reacting with PbS to form elemental lead and $Na_2S$;

cooling the lead bullion to a predetermined solidification temperature a $Na_2S$-$Cu_2S$ matte and a $Cu_3As$, $Cu_3Sb$ and $Fe_2As$ speiss forming on the surface of the molten lead pool during cooling with a substantial amount of the mechanically entrained and chemically released elemental lead falling into the molten lead pool; and separating the solidified matte and speiss from the lead bullion.

2. A process as claimed in claim 1 wherein the majority of the lead liberated from the addition of sodium-containing reagent is the result of the reaction:

$$2Na + PbS \rightarrow Na_2S + Pb$$

3. A process as claimed in claim 1 wherein the container means is a heat resistant massive cast iron mold.

4. A process as claimed in claim 1 wherein the pool of molten lead bullion has a cast temperature of about 1100°-1200° C.

5. A process as claimed in claim 1 wherein the sodium-containing reagent added to the lead is liquid sodium.

6. A process as claimed in claim 5 wherein the sodium is added in amount of 0.5-4.0 wt. % of the bullion.

7. A process as claimed in claim 5 wherein the sodium is added to the lead bullion after the bullion has been cooled to a temperature of 750°-800° C. and introduced below the surface of the matte covering the lead bullion.

8. A process as claimed in claim 1 wherein the separated matte has a lead content of less than about 10%.

9. A process as claimed in claim 1 wherein the matte, speiss and lead bullion are cooled to room temperature before separation.

10. A process as claimed in claim 1 wherein the bullion is cooled to the predetermined temperature at a predetermined rate.

* * * * *